US005132187A

United States Patent [19]

Morohashi

[11] Patent Number: 5,132,187

[45] Date of Patent: Jul. 21, 1992

[54] METHOD OF MANUFACTURING A COLOR CATHODE RAY TUBE AND AN EXPOSURE APPARATUS FOR USE IN WORKING THE METHOD

[75] Inventor: Katsuei Morohashi, Menuma, Japan

[73] Assignee: Kabushiki Kaisha Toshiba, Kawasaki, Japan

[21] Appl. No.: 531,309

[22] Filed: May 31, 1990

[30] Foreign Application Priority Data

| | | | |
|---|---|---|---|
| May 31, 1989 | [JP] | Japan | 1-138239 |
| May 31, 1989 | [JP] | Japan | 1-138240 |
| May 31, 1989 | [JP] | Japan | 1-138241 |
| Aug. 24, 1989 | [JP] | Japan | 1-217848 |

[51] Int. Cl.[5] ..... G03C 5/00

[52] U.S. Cl. ..... 430/24; 430/23; 430/26

[58] Field of Search ..... 430/23, 24, 25, 26; 354/1

[56] References Cited

U.S. PATENT DOCUMENTS

| | | | |
|---|---|---|---|
| 3,559,546 | 2/1971 | McKee | 354/1 |
| 4,027,312 | 5/1977 | Schlafer et al. | 430/24 |
| 4,050,081 | 9/1977 | Schultz | 430/24 |
| 4,053,904 | 10/1977 | Williams et al. | 430/24 |
| 4,053,906 | 10/1977 | Schultz | 430/24 |
| 4,059,834 | 11/1977 | Hosokoshi et al. | 430/24 |
| 4,122,461 | 10/1978 | Morean et al. | 430/24 |
| 4,135,930 | 1/1979 | Hosokoshi et al. | 430/24 |
| 4,234,669 | 11/1980 | Pearlman | 430/25 |
| 4,501,806 | 2/1985 | Watanabe et al. | 430/25 |
| 4,778,738 | 10/1988 | Lipp et al. | 430/26 |
| 4,855,200 | 8/1989 | Tomita et al. | 430/25 |

FOREIGN PATENT DOCUMENTS

| | | |
|---|---|---|
| 45-23656 | 8/1970 | Japan . |
| 51-29635 | 8/1976 | Japan . |
| 52-26986 | 7/1977 | Japan . |

OTHER PUBLICATIONS

Patent Abstract of Japan, "Exposure Device for Color Cathode Ray Tube", Sep. 6, 1985, E field vol. 6 No. 220.

Patent Abstract of Japan, "Optical Exposing Device for Panel's Inner Surace . . . ", Jul. 30, 1988, E field vol. 3 No. 5.

Patent Abstract of Japan, "Exposing Unit for Color Effective Tube . . . ", Jan. 18, 1979, E field, vol. 3, No. 5.

*Primary Examiner*—Hoa Van Le

*Attorney, Agent, or Firm*—Cushman, Darby & Cushman

[57] ABSTRACT

In a method of manufacturing a color cathode ray tube, a photosensitive layer is formed on a inner surface of a panel and a shadow mask is mounted in the panel. The photosensitive layer is exposed to a light beam which is emitted from a light source and passes through a lens system, a shutter and apertures of the shadow mask to form a pattern corresponding to the apertures of the shadow mask in an exposure step. In the exposure step, the shutter is moved along the inner surface of the panel and the light source is also moved in synchronism with the movement of the shutter. Thus, the light beam is so shifted as to satisfy the $\gamma - \Delta p$ characteristic of the cathode ray tube, which reflects the angle of deflection $\gamma$ of the electron beam and the corresponding displacement of the center (F) of the deflection $\Delta p$ from where the center of deflection would be when the angle of deflection is zero.

2 Claims, 15 Drawing Sheets

FIG. 6A
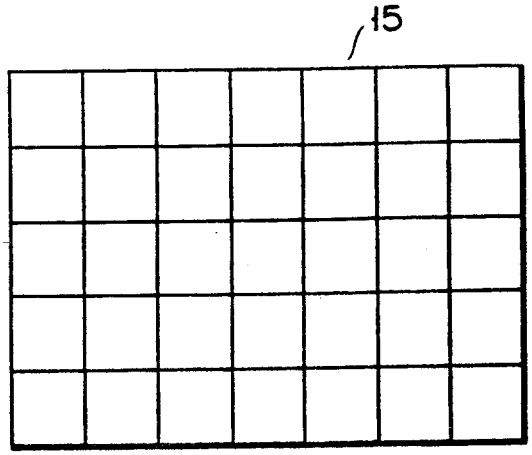
FIG. 6B
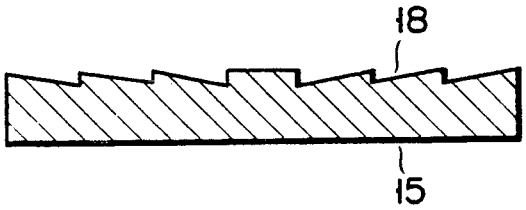
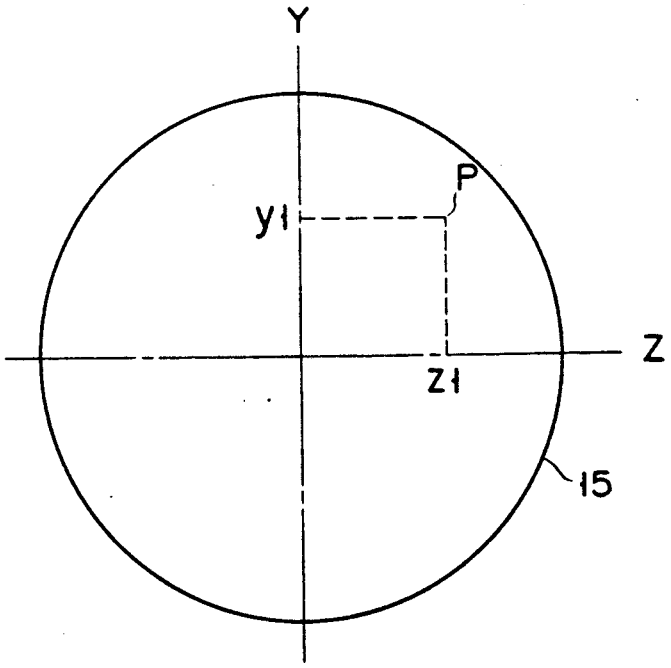
FIG. 7

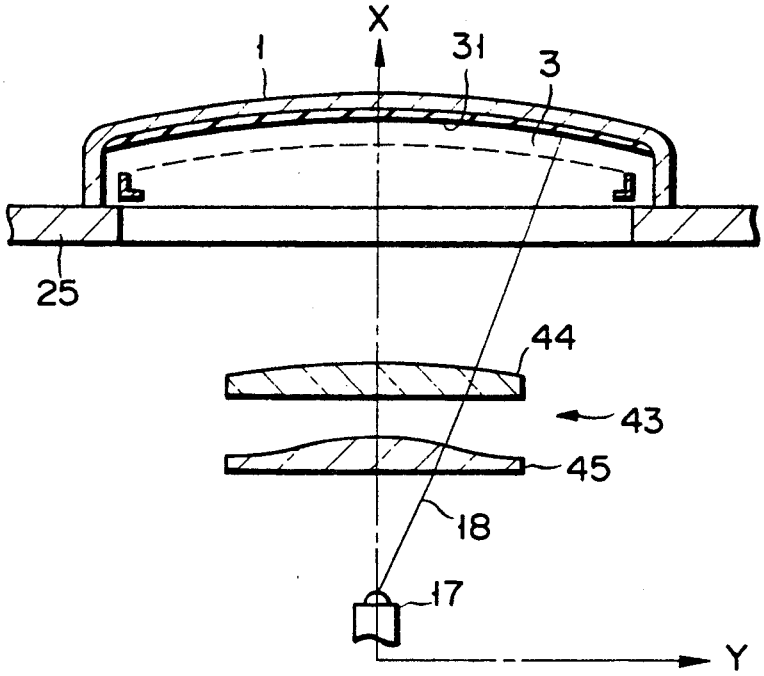
FIG. 21
FIG. 22A
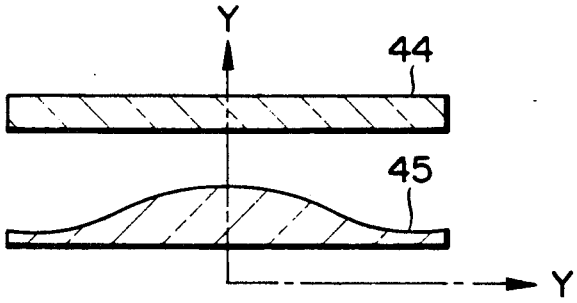
FIG. 22B
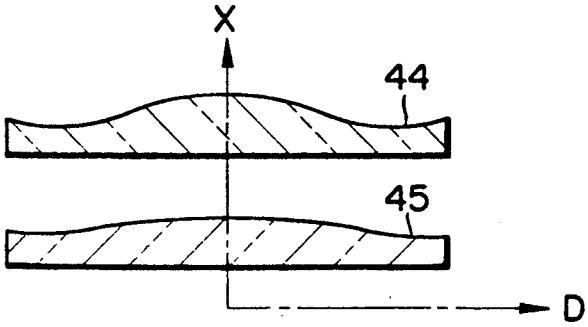

METHOD OF MANUFACTURING A COLOR CATHODE RAY TUBE AND AN EXPOSURE APPARATUS FOR USE IN WORKING THE METHOD

BACKGROUND OF THE INVENTION

1. Field of the Invention

The present invention relates generally to a method of manufacturing a color cathode ray tube and more particularly to a method of manufacturing a color cathode ray tube, thereby forming a phosphor screen having good landing characteristics. In addition, this invention relates to an exposure apparatus for use in working this method.

2. Description of the Related Art

In general, a color cathode ray tube comprises, as shown in FIG. 1, a panel 1 and a funnel 2 which constitute an outer casing. A phosphor screen 4 is attached to the inner surface of the panel 1. The phosphor screen 4 faces a shadow mask 3 disposed on the inside of the panel 1. The shadow mask 3 has a number of apertures The phosphor screen 4 comprises stripe-shaped or dot-shaped three color layers capable of emitting blue, green and red light. In order to improve the screen contrast, a so-called black stripe or black matrix screen may be employed, wherein non-light-emitting layers, which is made mainly of carbon and is free from light rays, are formed between the three color phosphor layers.

Three electron beams 6B, 6G and 6R, emitted from an electron gun assembly 5, impinge upon the phosphor screen 4. These beams are deflected horizontally and vertically by a magnetic field generated by a deflection yoke 7 mounted on the outer surface of the funnel 2. Thus, the beams are caused to scan the phosphor screen 4 to form images on the screen. In order to form images with high color purity on the phosphor screen 4, it is necessary that the three electron beams 6B, 6G and 6R, which have passed through apertures 8 in the shadow mask 3, impinge precisely upon the corresponding phosphor layers 9B, 9G and 9R, as shown in FIG. 2. A main problem in this case is that the directions, in which the electron beams 6B, 6G and 6R travel through the apertures 8 in shadow mask 3 and impinge upon the three color phosphor layers 9B, 9G and 9R, vary in accordance with the angles of deflection of the electron beams. In addition, in this case, the apparent deflection points or the centers of deflection from which the electron beam are straightly directed to the screen, shift in accordance with the angles of deflection. Under the situation, in order to cause the electron beams 6B, 6G and 6R to impinge precisely upon the corresponding phosphor layers 9B, 9G and 9R, it is therefore necessary to arrange the three color phosphor layers 9B, 9G and 9R over the entire inner surface of the panel 1, not with equal pitches, but with slightly different pitches in accordance with the respective apertures 8 in the shadow mask 3.

FIG. 3 illustrates the path of a center beam (6G) of three electron beams emitted from an in-line type electron gun assembly. Supposing that a deflection magnetic field 11 generated by the deflection yoke 7 is uniform, the electron beam 6G travels within the field 11 in an arcuate orbit. After the beam 6G has gone out of the field 11, it travels in a straight orbit and impinges upon the phosphor layer 9G through the aperture 8 in shadow mask 3. Thus, the apparent point of emission of the beam 6G, i.e. the center (F) of deflection at which the extended line of the straight orbit of the beam 6G crosses the tube axis (X-axis), varies in accordance with the angle $\gamma$ of deflection. In other words, when the electron beam is deflected at the angle $\gamma$, the center (F) of deflection is displaced by a displacement $\Delta p$ from the center of deflection obtainable when the angle of deflection is zero. Hereinafter, this characteristic of the beam is referred to as "$\gamma-\Delta p$ characteristic".

FIG. 4 illustrates the process of manufacturing a conventional phosphor screen. First, a phosphor slurry consisting mainly of a phosphor substance and a photosensitive resin is coated on the inner surface of a panel. Then, the phosphor slurry is dried. The resultant coating film is exposed through a shadow mask, so that image patterning corresponding to the apertures in the mask is printed on the coating film. The printed pattern is developed, and the non-exposed portion is removed. Thus, a phosphor layer of a given color is formed. This process is repeated to form three color phosphor layers, whereby a phosphor screen is manufactured. When a phosphor screen having a non-light-emitting layer is manufactured, a photosensitive resin is coated on the panel, prior to the formation of the three color phosphor layers. Then, a pattern corresponding to the apertures of the shadow mask is formed on those regions of the photosensitive resin layer, on which the three color phosphor layers are to be formed. Subsequently, a non-light-emitting substance is coated, and it is then removed along with the pattern on the photosensitive resin layer. Thus, a non-light-emitting layer, which has spaces on areas where the three color phosphor layers are to be formed, is obtained.

In the exposure step carried out to form the phosphor layer and non-light-emitting layer on the phosphor screen, an exposure apparatus as shown in FIG. 5 is employed. In this exposure apparatus, a correction lens 15 is arranged between an exposure light source 13 and a panel 1 on which a shadow mask 3 is mounted. A light beam, which is employed to expose a coating layer on the inner surface of the panel, travels in a straight orbit. In this exposure apparatus, the orbit of a light beam 14 emitted from the light source 13 is made similar to the orbit of an electron beam by means of the correction lens 15. The light beam 14, having the orbit similar to that of the electron beam, passes through an opening 17 of a shutter 16 and partly exposes the coating layer on the inner surface of panel 1.

A spherical lens was conventionally employed as correction lens 15. However, at present, an aspherical lens having a complex surface shape is substituted for the simple spherical lens because the spherical lens cannot satisfy the $\gamma-\Delta p$ characteristic in a color cathode ray tube having a complex structure.

If the center point of the bottom of the aspherical lens is supposed to be the origin of coordinates (x-axis, y-axis, z-axis), the height (x) at a given point on the surface of the lens is given by $$x=f(y, z) \quad (1)$$

In the polar coordinates, the height (x) is given by $$x = f(r, \theta) \quad (2)$$

$$r = \sqrt{y^2 + z^2}$$

-continued $$\theta = \tan(y/z)$$

Equation (1) is generally expressed by a polynomial expression:

$$x = \sum_{j,j=0}^{m} a_{ij} \cdot x_i \cdot y_i \quad (3)$$

When the correction lens is designed using these equations, the variations of the beam emitted from the exposure light source and caused to impinge upon the entire phosphor screen are examined in relation to the variations of coefficients aij, and the error between each incident point of the light beam on the phosphor screen and each corresponding incident point of the electron beam on the phosphor screen is set to be lower than a predetermined value (normally, 10 microns). It is relatively easy to decrease the errors of the incident points o a specific area of the surface of the correction lens; however, it is difficult to decrease the errors of the incident points on the entire surface of the lens. In general, the coefficients aij, which has been determined to reduce the error at a given point on the surface of the lens, may increase the errors at other points on the surface of the lens. Even if a high-performance, high-speed computer is used, a great deal of time would be taken in designing the correction lens, and also the change of the coefficients aij requires exact judgments based on long-time experience.

As has been stated above, in a color cathode ray tube employing a complex deflection magnetic field, for example, one having a wide deflection angle (110°) or one having a large size, it is extremely difficult, or impossible, to design a correction lens having desired characteristics.

Published Examined Japanese Patent Application No. 47-40983 and Published Examined Japanese Patent Application No. 49-22770 disclose other methods of designing the correction lens. Namely, according to these methods, as shown in FIGS. 6A and 6B, the correction lens 15 is divided into a plurality of portions, and the surfaces of these portions have their individual inclinations. The light beam orbits are made to agree with the corresponding electron beam orbits with high precision by the respective divisional portions of the lens, and the $\gamma-\Delta p$ characteristic is met. This type of correction lens 15, however, has stepped portions 18 at the boundaries of the divisional portions. In particular, in the case of manufacturing the black-stripe or black-matrix phosphor screen, which has the non-light-emitting layers in gaps between the three color phosphor layers, the phosphor screen may be made non-uniform owing to non-uniform exposure resulting from the stepped portions 18. In order to solve this problem, it has been proposed to swing the correction lens 15 or shield the stepped portions 18 during the exposure step; however, neither technique can improve the quality of the phosphor screen satisfactorily.

As has been described above, the correction lens is used in the process of manufacturing the phosphor screen of the color cathode ray tube. Namely, when a pattern corresponding to the apertures in the shadow mask is printed on a coating film such as phosphor slurry or photosensitive resin on the inner surface of the panel, the correction lens is employed to approximate the light beam orbit of the light beam, emitted from the exposure light source, to the electron beam orbit of the electron beam deflected by the magnetic field generated by the deflection yoke. The surface shape of the correction lens, however, is complex, and it is difficult to design the correction lens so as to obtain good landing characteristics all over the phosphor screen. In particular, no satisfactory correction lens is available, in manufacturing the color cathode ray tube employing a complex deflection magnetic field, for example, one having a wide deflection angle (110°) or one having a large size.

The inventor has studied the reasons why the correction lens cannot have good landing characteristics all over the phosphor screen, and he has found that the main reason is that the $\gamma-\Delta p$ characteristic of the electron beam at the time of horizontal deflection differs from the $\gamma-\Delta p$ characteristic of the electron beam at the time of vertical deflection.

More specifically, referring to FIG. 7, the height (x) at a given point P on the surface of correction lens 15 is determined, not by point P only, but by the total inclination of the correction lens 15 from its center axis. In addition, the curvature of the correction lens is generally determined so as to completely meet the landing characteristics both on the z-axis and the y-axis. The light beam can be completely corrected in both y-axis direction and z-axis direction, only in the case where the surface height (x) at a given point P, which is determined when a point z1 on the z-axis is moved along the y-axis up to a point y1, coincides with the surface height (x) at the point P, which is determined when the point y1 on the y-axis is moved along the z-axis up to the point z1. As shown in FIG. 8A, however, when the surface height at the point z1 on the z-axis is x (0, z1) and the surface height at the point P is determined by moving the point z1 up to the point y1 along the y-axis, the surface height at the point P is set to x2 on a curve 19*a*. On the other hand, as shown in FIG. 8B, when the surface height at the point y1 on the y-axis is x (0, y1) and the surface height at the point P is determined by moving the point y1 up to the point z1 along the z-axis, the surface height at the point P is set to x3 on a curve 19b. Namely, the correction of the electron beam when the surface height of the correction lens is determined by moving the point on the z-axis along the y-axis does not necessarily consistent with the correction of the electron beam when the surface height of the lens is determined by moving the point on the y-axis along the z-axis. In most cases, the former is inconsistent with the latter. The inventor has found that this inconsistency results from the difference between the center of horizontal deflection of the electron beam and the center of vertical deflection thereof, and that it would be impossible to design a correction lens capable of satisfactorily correcting landing errors all over the phosphor screen even if any formula of curved-surface indication is employed.

This problem is not so significant in a color cathode ray tube having a vertical-stripe phosphor screen, like a black-stripe phosphor screen, wherein vertical landing need not be considered; however, it is significant in a color cathode ray tube having dot-type phosphor layers, such as a color cathode ray tube having a wide deflection angle (110°) or a large-sized color cathode ray tube.

SUMMARY OF THE INVENTION

The present invention relates to a method of manufacturing a cathode ray tube including a phosphor screen having good landing characteristics, wherein a light beam orbit can be sufficiently approximated to an electron beam orbit, and also to an apparatus for use in working this method.

A method of manufacturing a color cathode ray tube, according to this invention, comprises the steps of forming a coating film of a photosensitive resin or phosphor slurry on the inner surface of a panel, irradiating the coating film with a light beam originating from a light source and passing through a shadow mask, and forming on the coating film a pattern corresponding to the apertures of the shadow mask, and developing the coating film to form a non-light-emitting layer or a phosphor layer, thereby forming a phosphor screen, wherein the pattern corresponding to the apertures of the shadow mask is formed on the coating film by limiting, by means of a shutter, those regions of the coating film formed on the inner surface of the panel, which are to be irradiated with a light beam emitted from the light source, and moving the light source relative to, and in synchronism with, the motion of the shutter, so as to make the horizontal deflection center and the vertical deflection center of the light beam coincide substantially with each other on the basis of the $\gamma-\Delta p$ characteristic of the light beam.

Further, the pattern corresponding to the apertures of the shadow mask is formed on the coating film by limiting, by means of a shutter, those regions of the coating film formed on the inner surface of the panel. These regions of coating film are irradiated with a light beam emitted from the light source. The light source is moved relative to, and in synchronism with, the motion of the shutter, in a plane including a light axis of the light source and one of a horizontal axis on a vertical axis, both intersecting at right angles with said light axis, so as to make the horizontal deflection center and the vertical deflection center of the light beam coincide substantially with each other on the basis of the $\gamma-\Delta p$ characteristic of the light beam.

More specifically, the light source is moved while controlling the amount of motion of the light source in the direction of the optical axis of the light source and the amount of motion of the light source in the direction of the horizontal axis or the vertical axis which intersects at right angles with the light axis. Therefore, when the light source is moved in a plane that includes said light axis and said horizontal axis, the pattern corresponding to the apertures in the shadow mask does not substantially move in the direction of the horizontal axis, in contrast to the pattern corresponding to the apertures in the shadow mask formed when the light source is fixed. Therefore, when the light source is moved in a plane that includes said optical axis and said vertical axis, said pattern corresponding to the apertures i the shadow mask does not substantially move in the direction of the vertical axis, in contrast to the pattern formed when the light source is fixed.

Further, in an exposure apparatus for use in forming a phosphor screen of a color cathode ray tube, there is provided an optical system for changing the orbit of a light beam generated from a light source. The light is generated for exposing a coating film of a photosensitive resin or phosphor slurry, which is formed on the inner surface of a panel, in synchronism with the motion of a shutter for limiting the region of the coating film to be exposed. Therefore, the light source moves, and the optical system is moved by a driving device, in synchronism with the motion of the shutter, thereby changing the orbit of the light beam.

Further, in an exposure apparatus for use in forming a phosphor screen of a color cathode ray tube, a correction lens is designed which approximates the orbit of a light beam to the orbit of an electron beam. The light beam is emitted from a light source of a light beam and projected onto a phosphor screen formation layer which is formed on the inner surface of a panel set in a predetermined position. The electron beam is emitted from an electron gun of a color cathode ray tube. The correction lens system includes a first lens for correcting mainly the orbit of the light beam projected to the phosphor screen formation layer on a horizontal axis and a vertical axis of the panel, which intersect at right angles with the axis of the tube as well as the vicinity thereof. There is also a second lens for correcting the orbit of the light beam orbit which is projected to regions of the phosphor screen formation layer other than the horizontal axis, the vertical axis and the vicinity thereof.

As has been stated above, the shutter is employed to limit those regions of the coating film made of photosensitive resin or phosphor slurry, which are to be exposed by light beams. In synchronism with the motion of the shutter, the exposure light source is moved so as to make the horizontal deflection center and the vertical deflection center, both based on the $\gamma-\Delta p$ characteristic, coincide substantially with each other. Thus, there is obtained a color cathode ray tube having excellent landing characteristics over the entire phosphor screen.

In synchronizing light source motion with shutter motion, the amount of motion of the light source is very small, and consequently it is difficult to mechanically move the light source with high precision. However, if the optical system for changing the light beam orbit is moved, as mentioned above, in synchronism with the shutter so that the light source moves deliberately, it can be regarded that the light source is equivalently moved by virtue of the change of the light beam orbit through the optical system.

Further, the correction lens for approximating the orbit of the light beam emitted from the light source to the orbit of the electron beam comprises the first and second lenses. The first lens mainly corrects the $\gamma-\Delta p$ characteristic of the light beam which is projected to the horizontal axis and the vertical axis of the panel and the vicinity thereof. The second lens mainly corrects the $\gamma-\Delta p$ characteristic of the light beam projected to the regions, other than the horizontal axis, the vertical axis and the vicinity thereof. Thus, it is possible to easily design a correction lens having the compatible inclination and thickness all over the lens surface, though this was conventionally difficult. Therefore, there is obtained a color cathode ray tube having excellent landing characteristics over the entire phosphor screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 6A and FIG. 6B are a plan view and a cross-sectional view for schematically showing a conventional correction lens having a plurality of divided surface regions;

FIG. 7 is a view for explaining a method of designing a conventional correction lens;

FIG. 21 is a cross-sectional view showing a schematic structure of an exposure apparatus used in manufacturing a phosphor screen of a color cathode ray tube according to another embodiment of this invention;

FIG. 22A and FIG. 22B are cross-sectional views of a lens system shown in FIG. 21.

DETAILED DESCRIPTION OF THE PREFERRED EMBODIMENTS

A method of manufacturing a color cathode ray tube, according to an embodiment of the present invention, will now be described with reference to the accompanying drawings.

Figure 1:
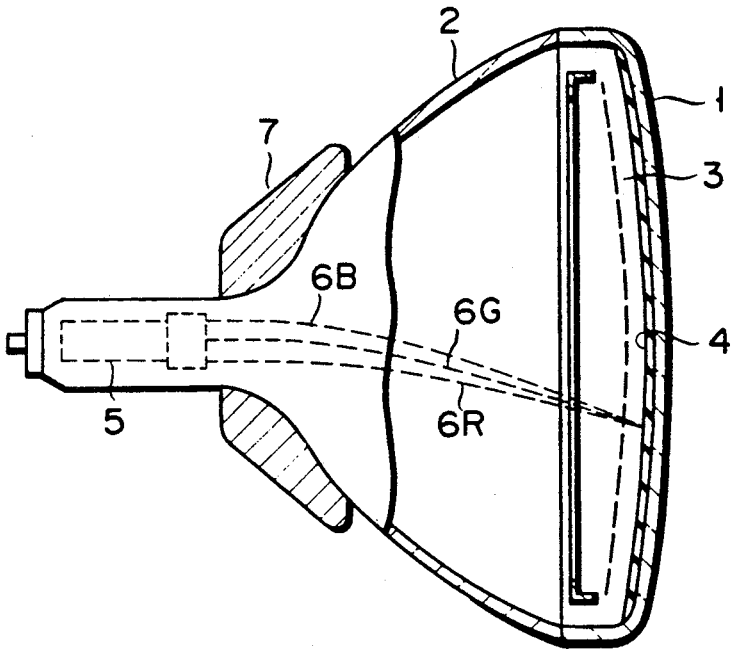
FIG. 1 is a cross-sectional view showing a schematic structure of a conventional color cathode ray tube.
Figure 2:
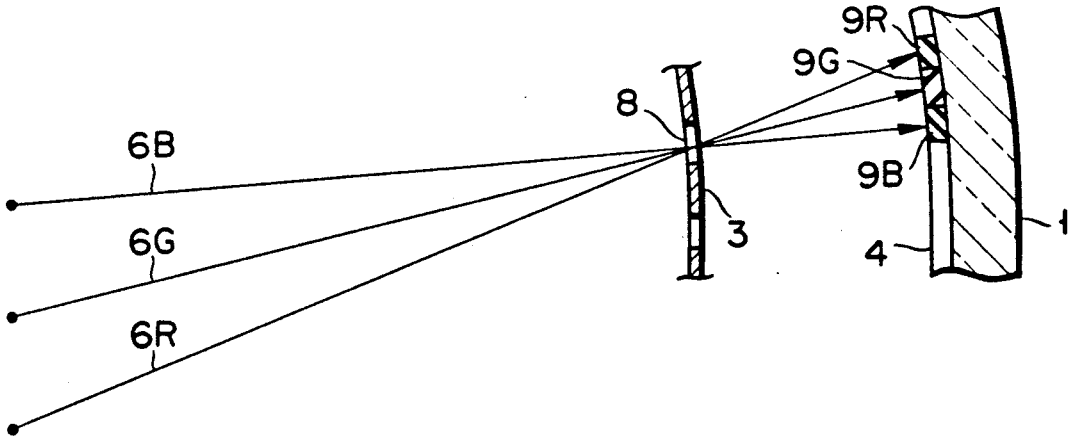
FIG. 2 is a partially enlarged view of FIG. 1, for explaining the landing of three electron beams on three color phosphor layers of a phosphor screen.
Figure 3:
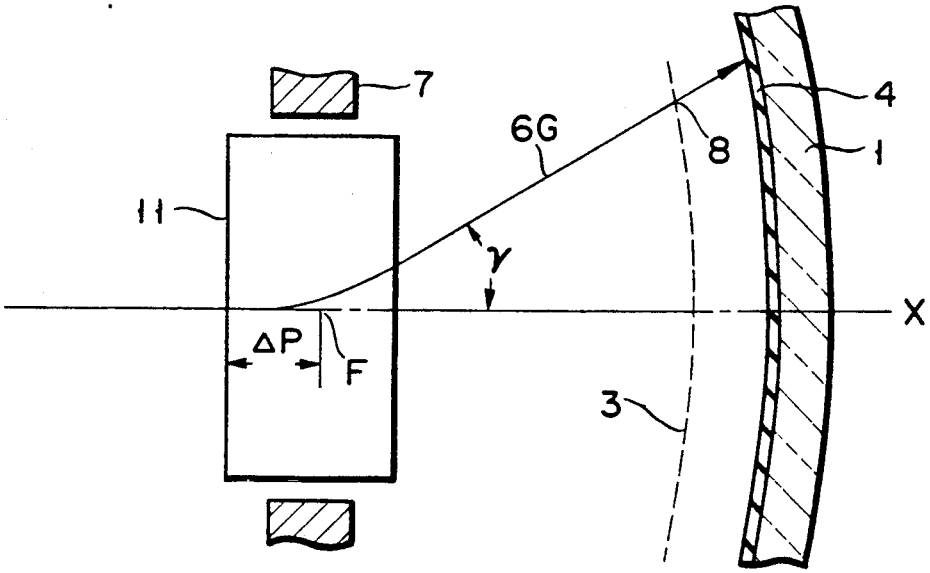
FIG. 3 is a partially enlarged view of FIG. 1, for explaining the fact that the center of deflection move as the electron beam is deflected by a deflection magnetic field.
Figure 5:
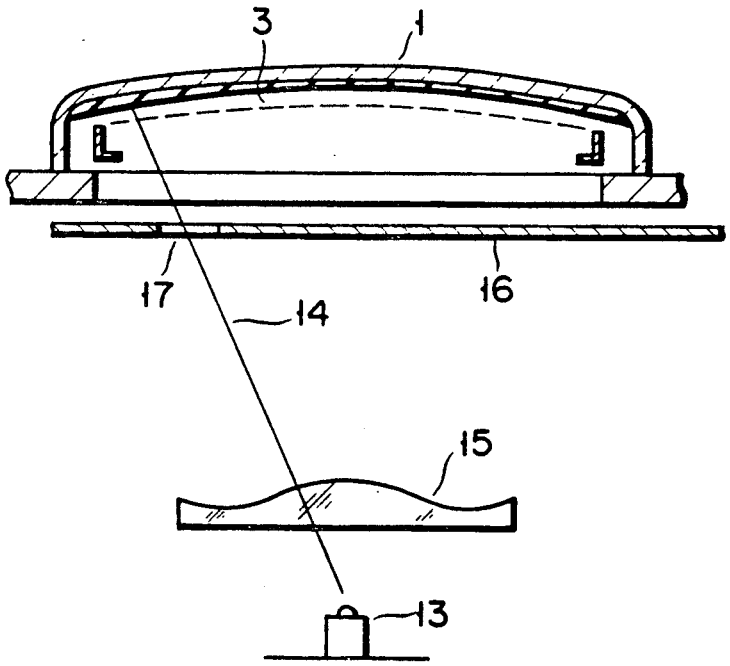
FIG. 5 is a cross-sectional view showing a schematic structure of a conventional exposure apparatus.
Figure 4:
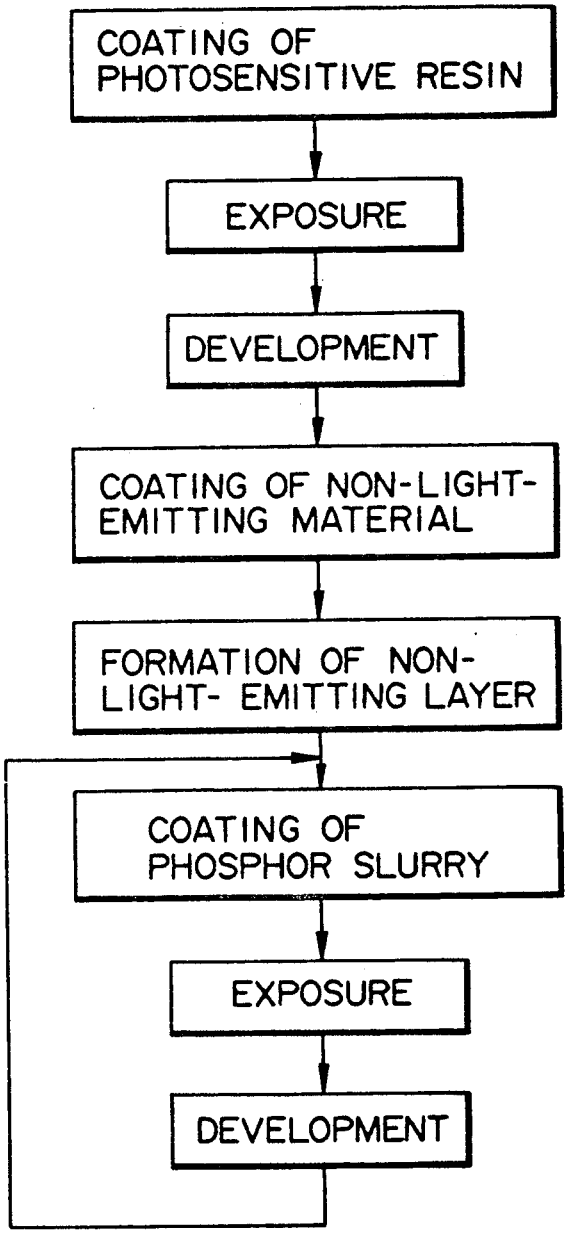
FIG. 4 is a block diagram for explaining a process of manufacturing a conventional phosphor screen.
Figure 8A:
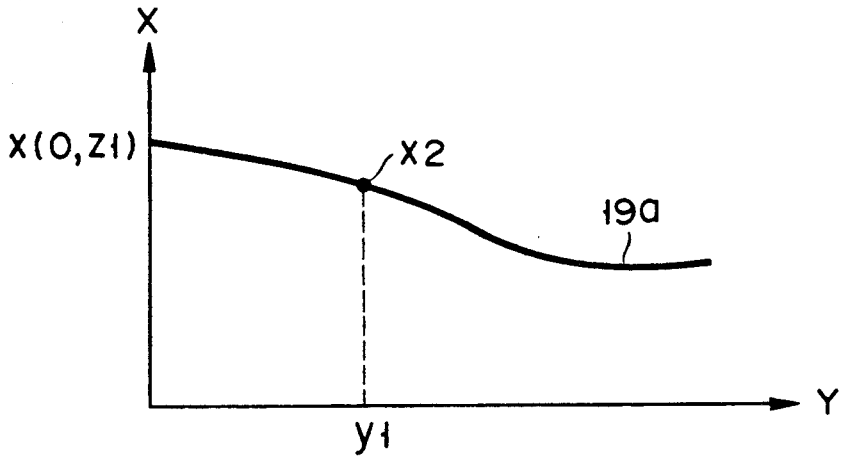
FIG. 8A and FIG. 8B show a z1-P cross section and a y1-P cross section of the correction lens shown in FIG. 7.
Figure 8B:
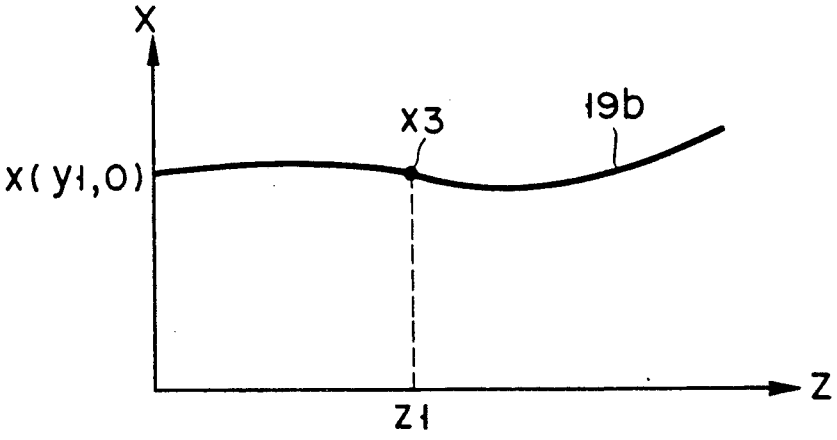
Figure 9:
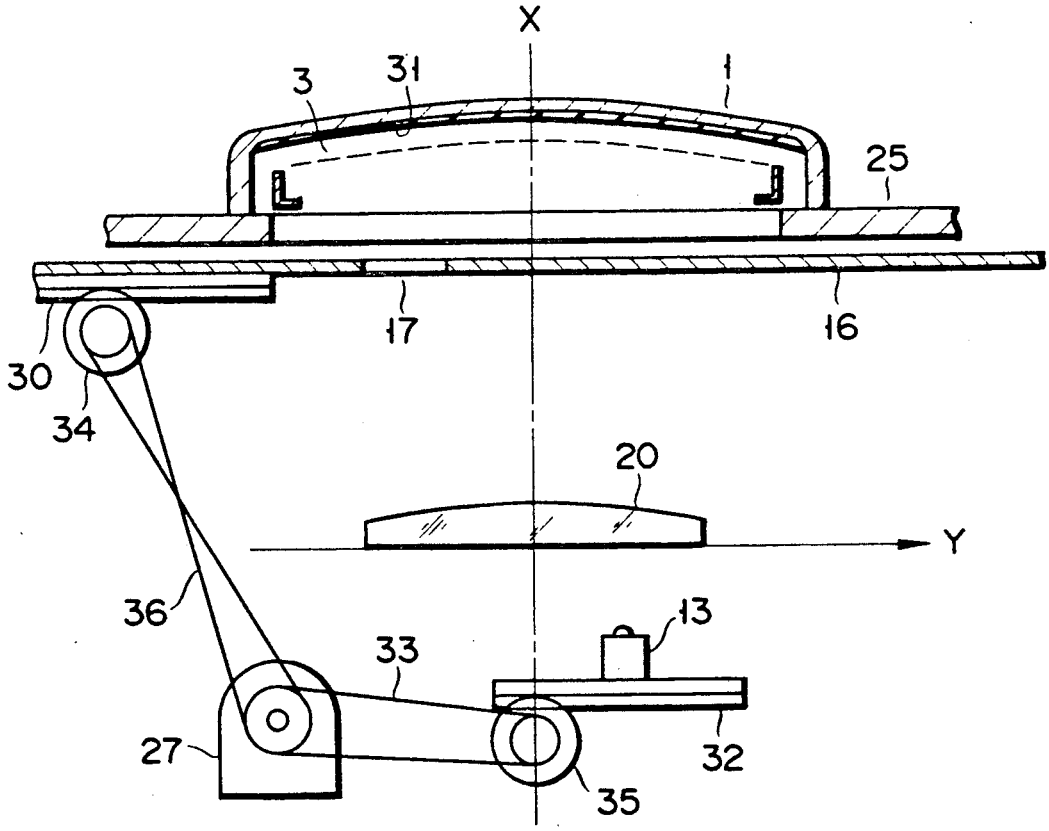
FIG. 9 is a cross-sectional view showing a schematic structure of an exposure apparatus used in manufacturing a phosphor screen, according to an embodiment of the present invention.
Figure 10:
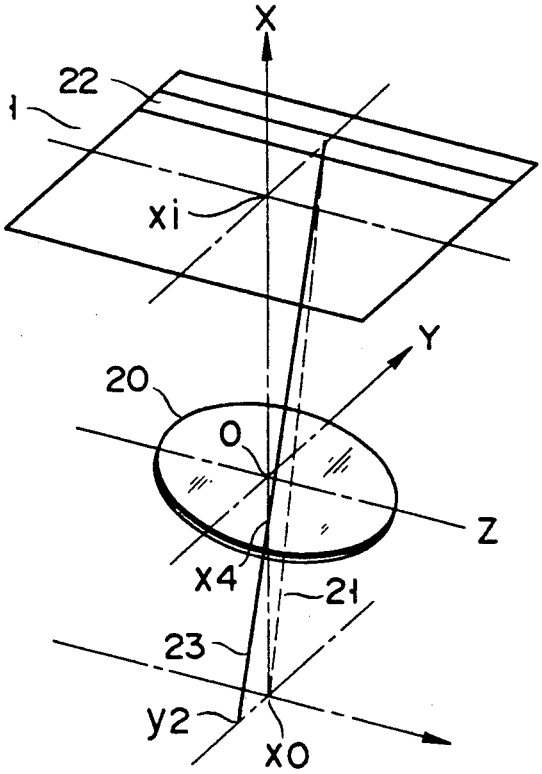
FIG. 10 is a perspective view for explaining the principle of exposure of the exposure apparatus shown in FIG. 9.
Figure 11:
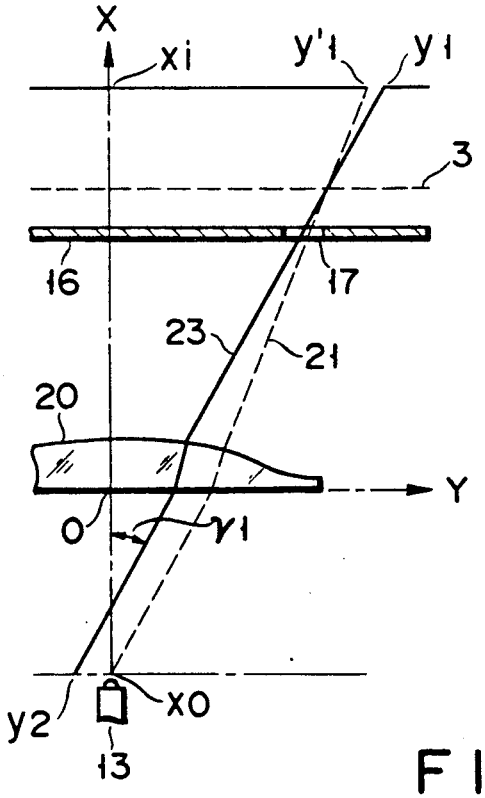
FIG. 11 is an X-Z cross-sectional view for explaining the principle of exposure of the exposure apparatus shown in FIG. 9.

FIG. 9 shows an exposure apparatus according to an embodiment of the present invention, and FIGS. 10 and 11 show orbits of light beams which pass through a correction lens shown in FIG. 9. Each of FIGS. 9, 10 and 11 includes coordinates wherein the center of the bottom surface of a correction lens 20, i.e. the center of the light source-side surface of lens 20, is set to the origin and the center axis of the correction lens 20 is set to the X-axis. In the coordinates of each figure, an exposure light source 13 is located on the X-axis (x0 (0, 0)). In addition, it is supposed that the inner surface of a panel 1 is a plane substantially parallel to a Y-Z plane including a point xi on the X-axis.

In this exposure apparatus, a light beam emitted from the light source 13 is refracted by the correction lens 20, as indicated by a broken line, and reaches a point y1' on the inner surface of the panel 1 through an opening 17 in a shutter 16 and an aperture in a shadow mask 3. A strip-like region 22 corresponding to the opening 17 in the shutter 16 is exposed by the light beam running towards the point y1'. When a point y1 is exposed, the exposure light source 13 is shifted, as shown by a solid line 23, by a distance y2 along the Y-axis in a Z-Y plane passing through the X-axis, in a direction of deflection (from point y1' to point y1), i.e. in a direction opposite to the direction of motion of the shutter (16). As a result, a strip-like region including the point y1 is exposed.

When the electron beam impinging upon the point y1' is deflected by the vertical deflection magnetic field of the deflector so as to impinge upon the point y1, the center of deflection of the vertical deflection magnetic field is shifted by a distance x4 towards the panel 1 from the center of deflection of the horizontal deflection magnetic field which is determined when the electron beam impinges upon the point y1. Thus, in order to cause the light beam to travel to the point y1 along the same orbit as the electron beam, it should suffice if the exposure light source 13 is shifted by a distance y2 in the Z-Y plane including the point x0, in the direction of deflection, i.e. in the direction opposite to the direction of motion of the shutter 16, as indicated by the solid line 23. Accordingly, when $\gamma=\gamma 1$ and $\Delta p=x4$ in connection with the $\gamma-\Delta p$ characteristic of the vertical deflection magnetic field, the following equation is given:

$$|y2|=X4\cdot\tan\gamma 1$$

Namely, it suffices if the exposure light source 13 is shifted by distance y2 in the direction opposite to the direction of motion of shutter 16.

The exposure light source 13 may be shifted to emit a light beam with excellent landing characteristics over the entire phosphor screen, in the following manner:

Attention should be paid to the $\gamma-\Delta p$ characteristic of the electron beam in the region on the phosphor screen near the line (Z-axis) indicated by z=z1 in FIG. 7. Regarding the $\gamma-\Delta p$ characteristic in the Z-axis when point y=0, the following is given:

$$\gamma=\gamma 2, \text{ and } \Delta p=X5$$

Regarding the $\gamma-\Delta p$ characteristic in the Z-axis when point $y=y1$, the following is given:

$$\gamma=\gamma 3, \text{ and } \Delta p=X6$$

If $X5>X6$, when $\gamma=\gamma 1$, $\Delta p$ is given by $$\Delta p=X4-(X5-X6)$$

The amount of motion y4 of the exposure light source 13, in this case, is represented by $$|y4|=\{X4-(X5-X6)\}\tan\gamma 1$$

How to determine the $\gamma-\Delta p$ characteristic varies depending on the location of that part of the phosphor screen, which is most important with respect to landing characteristics. In any case, when the value of $\Delta p$ in the $\gamma-\Delta p$ characteristic is xs, the amount of motion ym of the exposure light source 13 is given by $$|y4=xs\cdot\tan\gamma 1$$

The exposure apparatus shown in FIG. 9 has an arrangement wherein the light source is shifted in accordance with the $\gamma-\Delta p$ characteristic.

In this exposure apparatus, a support 25 is provided to position the panel 1. The exposure light source 13 is located below the support 25. The exposure light source 13 is typically a water-cooling or air-cooling very high pressure mercury lamp. Alternatively, a device emitting a laser beam through a waveguide such as an optical fiber may be used as the light source. The shutter 16 has an opening elongated in the Z-axis direction (horizontal) is arranged near and below the support 25. The correction lens 20 is arranged between the shutter 17 and exposure light source 13.

The shutter 16 and the exposure light source 13 have racks 30 and 32 for Y-axis (vertical) movement. Pinions 34 and 35 meshed with the racks 30 and 32 and belts 36 and 33 are driven by a drive motor 27, whereby the shutter 16 and the exposure light source 13 are moved synchronously in opposite directions along the Y-axis (vertical) intersecting at right angles with the longitudinal direction of the opening 17 of the shutter 16.

For example, a coating film 31 of phosphor slurry formed on the inner surface of the panel 1 is exposed through the shadow mask 3 by the above-described exposure apparatus. In accordance with the movement of the shutter 16, the exposed region of the coating film 31 shifts. The exposure light source 13 can be moved in accordance with the movement of the exposed region, so that the horizontal deflection center and the vertical deflection center, both based on the $\gamma-\Delta p$ characteristic, can be made to coincide with each other. Thus, there can be obtained a color cathode ray tube having phosphor screen with good landing characteristics, wherein three color phosphor layers are formed at suitable locations on the inner surface of the panel 1.

According to the method and apparatus of the present invention, it is not necessary to make a compromise with the design of the correction lens by making the surface height at a given point of the lens, which is obtained from the z-axis, coincide with the surface height at that point, which is obtained from the y-axis, as in the prior art. According to this invention, the surface height of the correction lens can be determined only from the z-axis, and the design of the correction lens is made easier.

The above embodiment is directed to the case where the shutter and the exposure light source are moved in the Y-axis direction; however, they may be moved in the Z-axis direction.

The correction lens employed is not limited to the lens having a surface shape represented by a single formula such as:

$$x=f(y, z)$$

The correction lens may have a surface shape represented by a plurality of formulae, or the lens may have divided blocks and stepped portions.

When the light beam orbit does not cross the X-axis, the $\gamma-\Delta p$ characteristic may be found on the basis of the crossing angle obtainable when the light beam orbit is projected on the Y-X plane or Z-X plane.

An exposure apparatus according to another embodiment of the present invention will now be described with reference to the accompanying drawings.

In the same manner as in FIGS. 10 and 11, coordinates are determined such that the center of the bottom surface (light-source-side surface) of the correction lens 20 is set to the origin and the center axis of the correction lens 20 is set to the X-axis. It is supposed that the exposure light source 13 is located at a point x0 (0, 0) on the X-axis. It is also supposed that the inner surface of the panel 1 is a plane including a point xi on the X-axis, which is parallel to the Y-Z plane. In this case, a light beam emitted from the light source 13 is refracted by the correction lens 20, as indicated by a broken line, and reaches a point y1' on the inner surface of the panel 1 through an opening 17 in a shutter 16 and an aperture in a shadow mask 3. A strip-like region 22 corresponding to the opening 17 in the shutter 16 is exposed. When the electron beam impinging upon the point y1' is deflected by the vertical deflection magnetic field of the deflector so as to impinge upon the point y1, the center of deflection of the vertical deflection magnetic field is shifted by a distance x4 towards the panel 1 from the center of deflection of the horizontal deflection magnetic field which is determined when the electron beam is let to impinges upon the point y1. Thus, in order to cause the light beam to travel to the point y1 along the same orbit as the electron beam, it should suffice if the exposure light source 13 is shifted by a distance y2 in the Z-Y plane including the point x0, in the direction of deflection (y1−y1' direction), i.e. in the direction opposite to the direction of Y-axis motion of the shutter 16, as indicated by the solid line 23. Accordingly, when $\gamma=\gamma 1$ and $\Delta p=x4$ in connection with the $\gamma-\Delta p$ characteristic of the vertical deflection magnetic field, the following equation is given:

$$|y2=X4\cdot\tan\gamma 1$$

Namely, it suffices if the exposure light source 13 is shifted by distance $|y2|$ in the direction opposite to the direction of motion of shutter 16.

The exposure light source 13 may be shifted to emit a light beam with excellent landing characteristics over the entire phosphor screen, in the following manner:

Attention should be paid to the $\gamma-\Delta p$ characteristic near the line (Z-axis) indicated by $z=z1$ in FIG. 7. Regarding the $\gamma-\Delta p$ characteristic in the Z-axis when point $y=0$, the following is given:

$\gamma-\gamma 2$, and $\Delta p=X5$

Regarding the $\gamma-\Delta p$ characteristic in the Z-axis when point $y-y1$, the following is given:

$\gamma=\gamma 3$, and $\Delta p=X6$

Figure 12A:
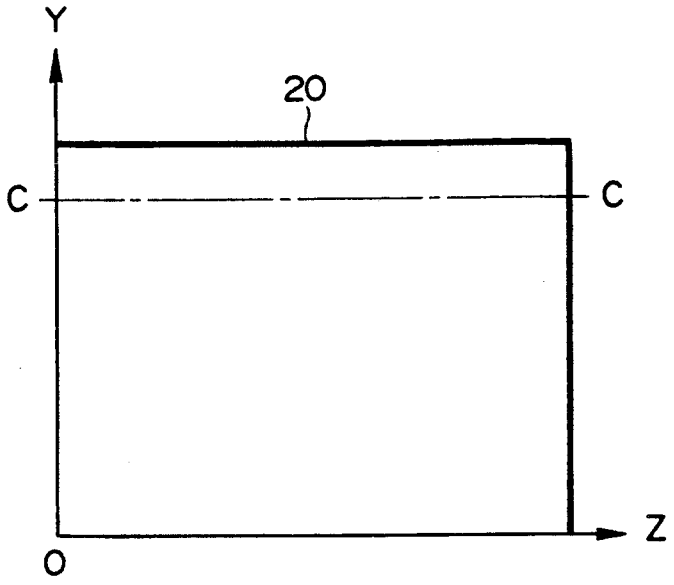
FIG. 12A, FIG. 12B and FIG. 12C are views for explaining the surface shape of a correction lens.
Figure 12B:
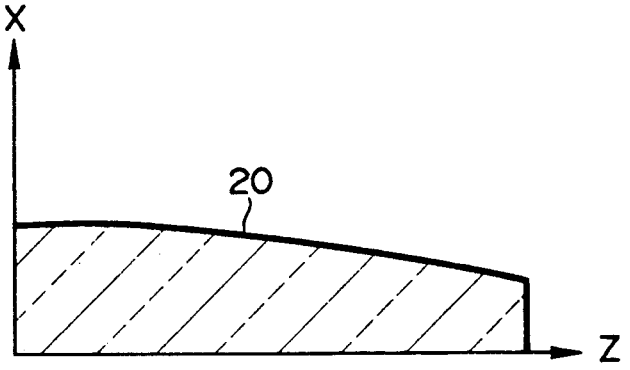
Figure 12C:
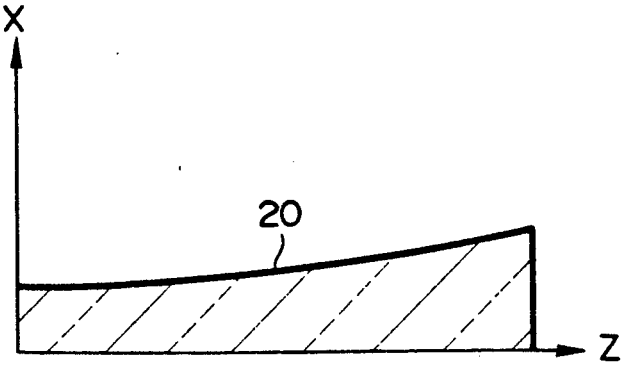
Figure 13A:
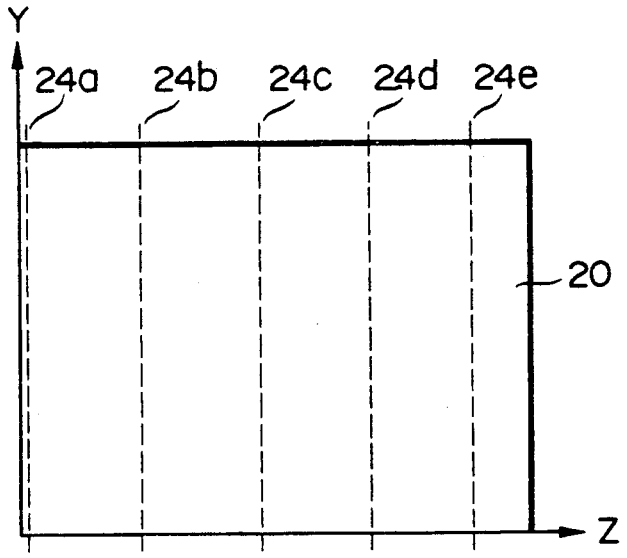
FIG. 13A and FIG. 13B are views for explaining landing errors of a light beam, the orbit of which is corrected by a correction lens.
Figure 13B:
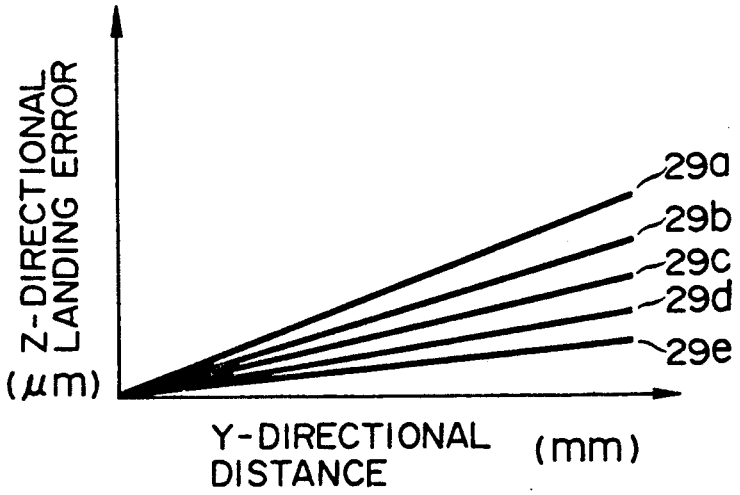

If $X5>X6$, when $\gamma=\gamma 1$, $\Delta p$ is given by $\Delta p=X4-(X5-X6)$ The amount of motion y4 of the exposure light source 13, in this case, is represented by $|y4=\{X4-(X5-X6)\}\tan\gamma 1$ How to determine the $\gamma-\Delta p$ characteristic varies depending on the location of that part of the phosphor screen, which is most important with respect to landing characteristics. In any case when the value of $\Delta p$ in the $\gamma-\Delta p$ characteristic is xs, the amount of motion ym of the exposure light source 13 is given by $|y4=xs\cdot\tan\gamma 1$ According to this method, the inner surface of the panel is exposed with an image pattern of the apertures of the shadow mask, while the exposure light source 13 is moved in a direction opposite to the direction of motion of the shutter 16. With the use of the correction lens 20 having the surface height determined only based on the Z-axis, the phosphor screen with slight landing errors can be obtained. The landing errors on the Y-axis is reduced substantially to zero over the entire phosphor screen. However, as seen from FIGS. 12B and 12C showing an 0-Z cross section (taken along the Z-axis) of the correction lens 20 shown in FIG. 12A and a C-C cross section (taken along a line parallel to the Z-axis), the surface height on the Z-axis (FIG. 12B) decreases towards the periphery of the lens, whereas the surface height on the axis apart from the Z-axis (FIG. 12C) increases towards the periphery of the lens. The landing errors on the Y-axis and lines 24*a* to 24*e* parallel to the Y-axis (FIG. 13A) increase as the value on the Z-axis increases, as shown by lines 29*a* to 29*e* in FIG. 13B.

Figure 14A:
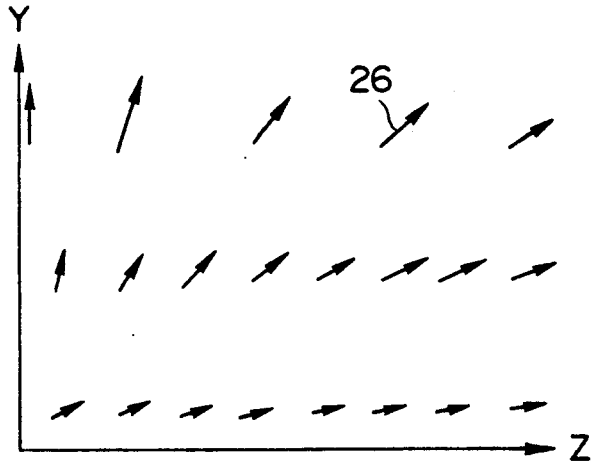
FIG. 14A, FIG. 14B and FIG. 14C are views for explaining the shift of exposure points and the correction of landing errors, when an exposure light source is moved in synchronism with the motion of a shutter.

When the exposure light source is moved in the X-direction in synchronism with the motion of the shutter in the Y-direction, the exposure points (i.e. exposure images or patterns corresponding to the apertures in the shadow mask) move in the directions indicated by arrows 26 in FIG. 14A. In FIG. 14A, the length of each arrow 26 represents the amount of relative motion. On the other hand, when the exposure light source is moved in the Y-direction in synchronism with the motion of the shutter in the Y-direction, the exposure points move in the directions indicated by arrows 27 in FIG. 14B. Thus, if the exposure light source is moved in the X-direction and Y-direction and the amounts of X-directional and Y-directional motion are adjusted, the exposure points do not move in the Y-direction, as shown by arrows 28 in FIG. 14C, compared to the exposure points obtainable when the phosphor screen is formed with use of a fixed light source. In addition, the landing errors, illustrated in FIG. 13B, occur only in the Z-axis.

Figure 14B:
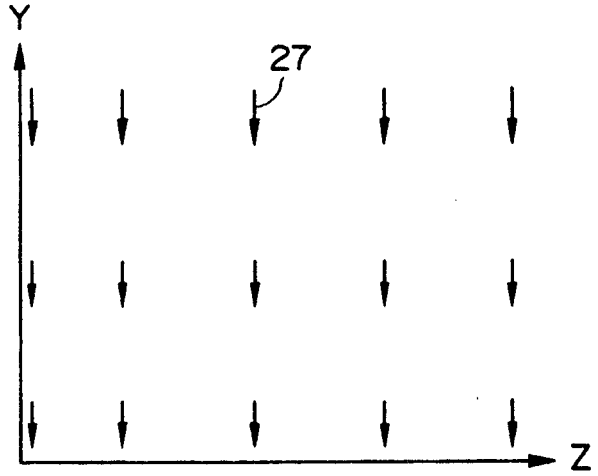
Figure 14C:
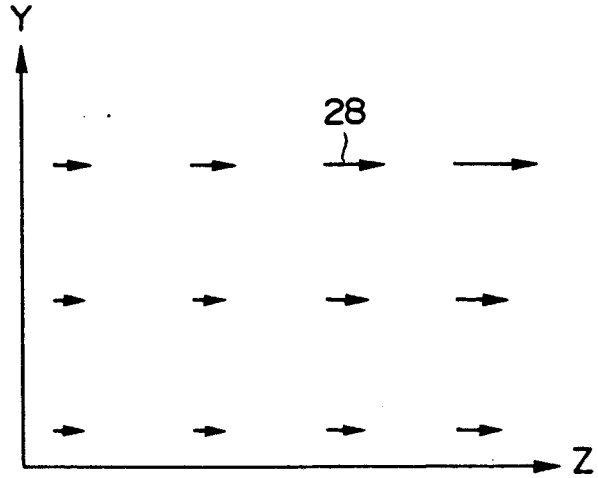

In FIGS. 14A, 14B and 14C, the direction of the arrows 26 to 28 is reversed if the shutter and the exposure light source are moved in the opposite direction. In addition, the landing errors, shown by arrows 28 in FIG. 14C, can be adjusted to desired values by controlling the amount of motion of the exposure light source.

Figure 15:
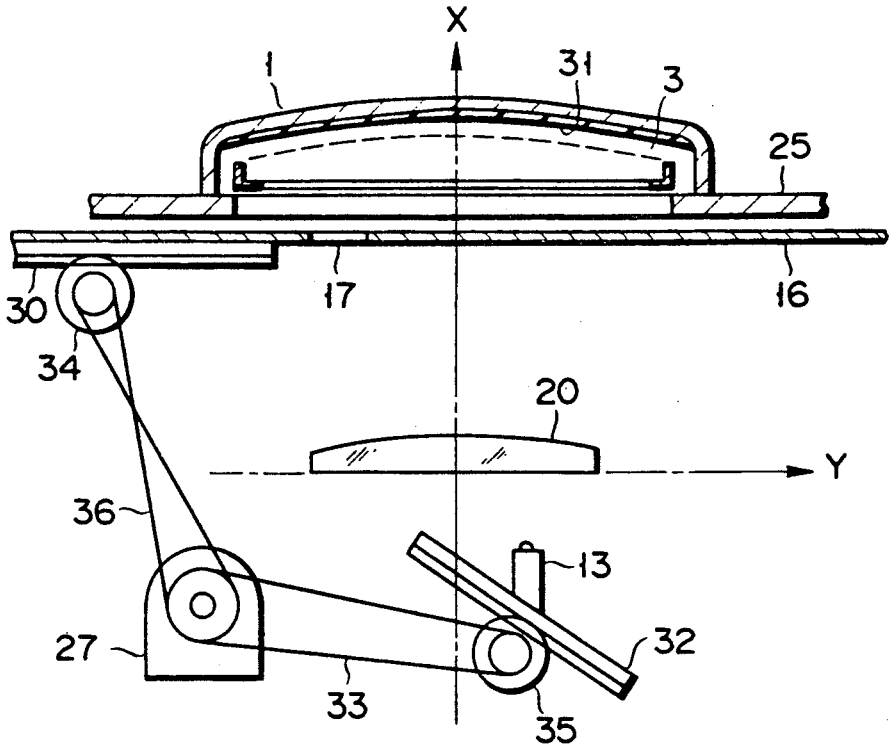
FIG. 15 is a cross-sectional view showing a schematic structure of an exposure apparatus used in manufacturing a phosphor screen, according to another embodiment of the present invention.

FIG. 15 shows an exposure apparatus for working the above-described process of correcting the landing errors. Like the apparatus shown in FIG. 9, this exposure apparatus has a support 25 for positioning a panel 1. An exposure light source 13 is arranged below the support 25. A shutter 16 having an opening 17 elongated in the Z-direction (horizontal) near and below the support 25. A correction lens 20 is arranged between the shutter 16 and the exposure light source 13.

The shutter 16 has a rack 30, by means of which the shutter 16 is allowed to move in the Y-direction (vertical). The exposure light source 13 has a rack 32 inclined with respect to the Y-axis. The rack 32 allows the light source 13 to move simultaneously in the X- and Y-directions. A drive motor 27 rotates pinions 34 and 35 meshed with the racks 30 and 32 via belts 36 and 33. Thus, the shutter 16 and the exposure light source 13 are synchronously moved in opposite directions, both perpendicular to the longitudinal axis of the elongated opening 17 of shutter 16, and the exposure light source 13 is also moved with an angle in the X-Y plane.

Figure 16:
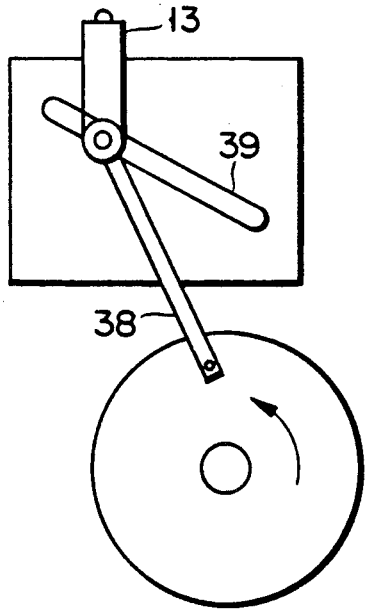
FIG. 16 shows a modification of the exposure apparatus shown in FIG. 15.

FIG. 16 shows a modification of the mechanism of moving the exposure light source 13. The light source 13 is coupled to a crank mechanism 38 driven by the drive motor. The light source 13 is moved along a guide groove 39 formed with an angle in respect to the Y-axis. In this case, the landing errors can be effectively corrected by changing the shape of the guide groove 39.

For example, a coating film 31 of phosphor slurry formed on the inner surface of the panel 1 is exposed through the shadow mask 3 by the above-described exposure apparatus. In accordance with the movement of the shutter 16, the exposed region of the coating film 31 shifts. The exposure light source 13 can be moved in accordance with the movement of the exposed region, so that the horizontal deflection center and the vertical deflection center, both based on the $\gamma-\Delta p$ characteristic, can be made to coincide with each other. Thus, there can be obtained a color cathode ray tube having a phosphor screen with excellent landing characteristics, wherein three color phosphor layers are formed at suitable locations on the inner surface of the panel 1.

According to the method and apparatus of the present invention, it is not necessary to make a compromise with the design of the correction lens by making the surface height at a given point of the lens, which is obtained from the z-axis, coincide with the surface height at that point, which is obtained from the y-axis, as in the prior art. According to this invention, the surface height of the correction lens can be determined only from the z-axis, and the design of the correction lens is made easier.

The above embodiment is directed to the case where the shutter is moved in the Y-axis direction and the exposure light source is moved in the Y-X plane; however, the shutter may be moved in the Z-axis direction and the exposure light source may be moved in the Z-X plane.

The correction lens employed is not limited to the lens having a surface shape represented by a single formula such as:

$x=f(y, z)$

The correction lens may have a surface shape represented by a plurality of formulae, or the lens may have divided blocks and stepped portions.

When the light beam orbit does not cross the X-axis, the $\gamma-\Delta p$ characteristic may be found on the basis of the crossing angle obtainable when the light beam orbit is projected on the Y-X plane or Z-X plane.

Figure 17:
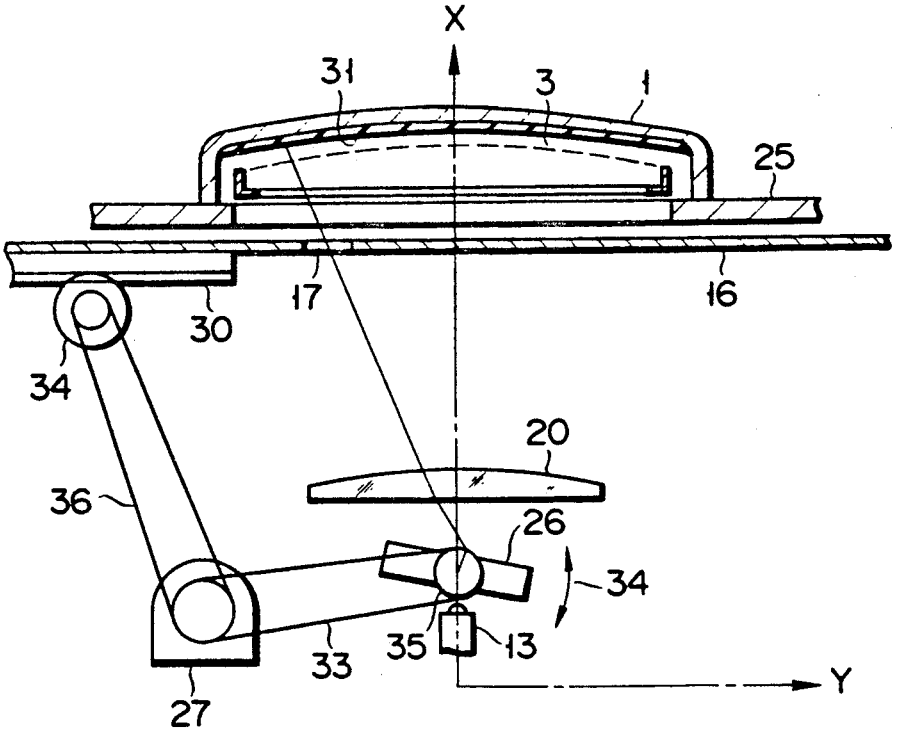
FIG. 17 is a cross-sectional view showing a schematic structure of an exposure apparatus used in manufacturing a phosphor screen of a color cathode ray tube, according to another embodiment of this invention.

FIG. 17 shows an exposure apparatus for working the exposure process, according to still another embodiment of the invention. Like the apparatus shown in FIG. 9, this exposure apparatus has a support 25 for positioning a panel 1. An exposure light source 13 is arranged below the support 25. A shutter 16 having an opening 17 elongated in the Z-direction (horizontal) near and below the support 25. A correction lens 20 is arranged between the shutter 16 and the exposure light source 13. Further, a light beam path changing optical system 26 for changing the path of a light beam is arranged between the correction lens 20 and the exposure light source 13, and near the light source 13. The optical system 26 is formed of a flat refractive body, such as a glass plate.

The shutter 16 is provided with a rack 30 which allows the Y-directional (vertical movement of the shutter 16. A pinion 34 meshed with the rack 30 is rotated by a motor 27 via a belt 36 in forward and reverse directions, whereby the shutter 16 is moved reciprocally in the Y-direction. A pulley 35 is attached to a middle part of the light beam path changing optical system 26. The pulley 35 is driven by the motor 27 via a belt 33. Thus, the optical system 26 is swung in synchronism with the reciprocal motion of the shutter 16 in the Y-direction, as indicated by an arrow 34.

As has been stated above, in order to manufacture a phosphor screen having good landing characteristics, it is necessary to limit the regions to be exposed ("partial exposure"), and to move the exposure light source 13 so as to make the horizontal deflection center and the vertical deflection center, both based on the $\gamma-\Delta p$ characteristic, coincide with each other. According to the exposure apparatus as shown in FIG. 17, the light beam path changing optical system 26 is swung, so that the orbit of the light beam emitted from the exposure light source 13 can be adjusted with high precision as if the light source 13 were shifted. In this invention, the partial exposure is carried out by swinging the optical system 26 in synchronism with the motion of the shutter 16, thereby obtaining a phosphor screen having excellent landing characteristics all over the inner surface of the panel 1.

For example, in the case of a color cathode ray tube having a size of 25 inches and a deflection angle of 100°, the amount of motion of the exposure light source 13, which is necessary for forming a desired phosphor screen, is about 0.2 mm. The exposure light source 13 is moved by this amount in precise synchronism with the motion of the shutter 16. It is very difficult from the point of view of technical aspects, to mechanically move the light source 13 by such a slight amount with high precision. However, when the light beam path changing optical system 26, which is formed of a glass plate, is employed, the dimensions of the parts of the exposure apparatus for manufacturing the color cathode ray tube having a size of 25 inches and a deflection angle of 100°, can be determined as follows:

| | |
|---|---|
| Distance between the light source 13 to the bottom surface of the correction lens 20 | 63.15 mm |
| Distance between the light source 13 to the shutter 16 | 215.05 mm |
| Distance between the light source 13 to the shadow mask 3 | 326.05 mm |
| Distance between the light source 13 to the inner surface of the panel 1 | 336.35 mm |
| Thickness of the middle part of the correction lens 20 | 8 mm |

Figure 18:
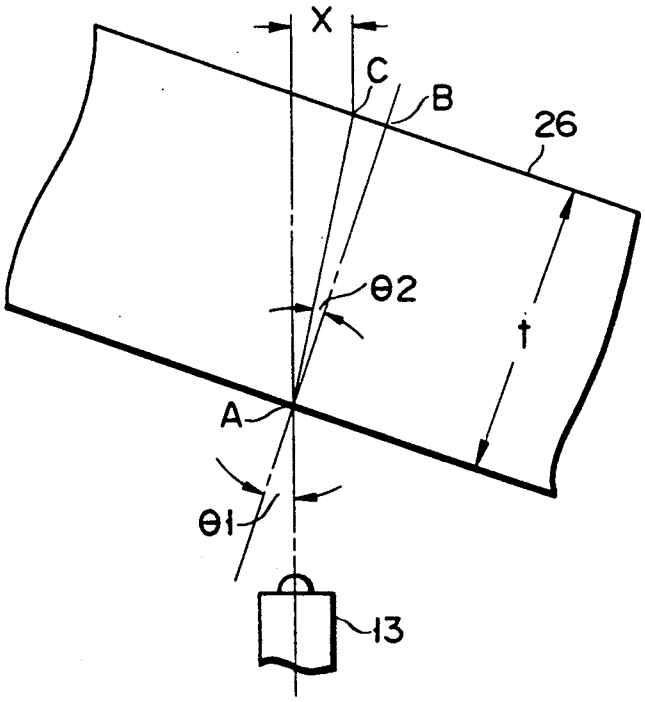
FIG. 18 is a partly enlarged side view of a light beam path changing optical system shown in FIG. 17.

When the light beam path changing optical system 26 is formed of a thin flat glass plate and the refractive index n thereof is 1.5168, and if the inclination of the optical system 26 is small, as shown in FIG. 18, the following equation is established:

$$AB=AC$$

Supposing that the thickness of the optical system 26 is t, the incident angle of a light beam onto the optical system 26 is $\theta 1$, and the refractive index is $\theta 2$, the apparent amount of motion x of the light source 13 is given by $$\begin{aligned} x &= t\sin(\theta 1-\theta 2) \\ \theta 2 &= \sin^{-1}(\sin\theta 1\times 1{,}5168) \\ \sin\theta 1 &= \sin\theta 2 = \sin\theta 1-\sin(\sin^{-1}\times 1.5168) \\ &= \sin\theta 1-1{,}5168\sin\theta 1 \\ -1.5168\sin\theta 1 &= x/t \end{aligned}$$

Thus, when the thickness t of the glass plate is 10 mm, and if the amount of motion of light source 13 is 0.2 mm, the following is given:

$$\begin{aligned} -1{,}5168\sin\theta 1 &= 0.02 \\ \theta 1 &= -2{,}2^\circ \end{aligned}$$

In addition, if the thickness of the glass plate is 1 mm, the following is given:

$$\begin{aligned} -1{,}5168\sin\theta 1 &= 0.2 \\ \theta 1 &= -2.28^\circ \end{aligned}$$

Namely, when the thickness t of the glass plate of the light beam path changing optical system 26 is, for instance, 1 mm, it suffices if the optical system 26 is inclined by about 23°, in relation to the maximum amount of motion of the shutter 16. It is possible to incline the optical system 26 with high precision, in synchronism with the motion of the shutter 16.

According to this exposure apparatus, it is not necessary to make a compromise with the design of the correction lens by making the surface height at a given point of the lens, which is obtained from the z-axis, coincide with the surface height at that point, which is obtained from the y-axis, as in the prior art. According to this embodiment, the surface height of the correction lens can be determined only from the z-axis, and the desirable phosphor screen can be obtained.

Figure 19:
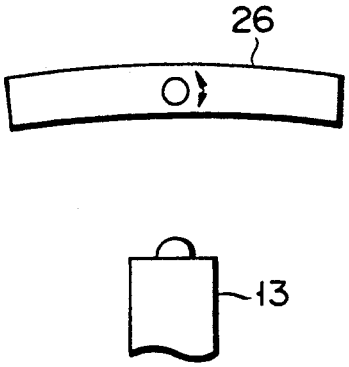
FIG. 19 and FIG. 20 schematically show modifications of the exposure apparatus shown in FIG. 17.

In the above embodiment, the light beam path changing optical system of the exposure apparatus was formed of a flat glass plate; however, as shown in FIG. 19, the optical system may have a spherical concave surface on its side closer to the light source 13.

Figure 20:
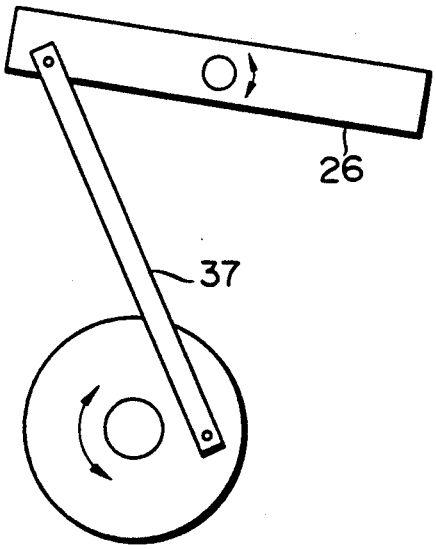

In the above embodiment, the swing mechanism for swinging the light beam path changing optical system employed a belt, a pulley, etc.; however, as shown in FIG. 20, a crank mechanism 37, etc. may also be employed. In particular, when the crank mechanism 37 is used as the swing mechanism, the angle of swing can be easily adjusted by changing the position where the crank mechanism 37 is attached to the optical system 26.

The above embodiment is directed to the case where the shutter is moved in the Y-axis direction; however, the shutter may be moved in the Z-axis direction.

The correction lens employed is not limited to the lens having a surface shape represented by a single formula such as:

$$x=f(y, z)$$

The correction lens may have a surface shape represented by a plurality of formulae, or the lens may have divided blocks and stepped portions.

When the light beam orbit does not cross the X-axis, the $\gamma-\Delta p$ characteristic may be found on the basis of the crossing angle obtainable when the light beam orbit is projected on the Y-X plane or Z-X plane.

FIG. 21 shows an exposure apparatus according to still another embodiment of the present invention. Like the apparatus shown in FIG. 9, this exposure apparatus includes a support 25 for positioning the panel 1. An exposure light source 17 is arranged below the support 25. A correction lens system 43 comprising first and second lenses 45 and 44 is arranged above the light source 17. A light beam 18 is emitted from the light source 17 and is projected through a shadow mask 3 onto a phosphor screen formation layer 31 (e.g. formed of phosphor slurry or photosensitive resin) coated on the inner surface of the panel 1 positioned by the support 25. The correction lens system 43 functions to approximate the orbit of the light beam 18 to the orbit of an electron beam emitted from an electron gun of a color cathode ray tube.

The first lens 45 of the correction lens system 43 is designed mainly to correct the $\gamma-\Delta p$ characteristic of the light beam 18 projected to the horizontal axis (Z-axis) and the vertical axis (Y-axis) of the panel 1, which intersect at right angles with the tube axis, and also to correct the $\gamma-\Delta p$ characteristic of the light beam 18 projected to the vicinity of the horizontal axis and the vertical axis of the panel 1. On the other hand, the second lens 44 is designed mainly to correct the $\gamma-\Delta p$ characteristic of the light beam 18 projected to the regions, other than the horizontal axis, the vertical axis, and the vicinity thereof.

More specifically, the $\gamma-\Delta p$ characteristic of the light beam 18 projected to the horizontal axis and the vertical axis of the panel 1 and the vicinity thereof is corrected by the first lens 45, and is not substantially corrected by the second lens 44. Meanwhile, the $\gamma-\Delta p$ characteristic of the light beam 18 projected to the regions, other than the horizontal axis, the vertical axis and the vicinity thereof are not satisfactorily corrected. On the other hand, the $\gamma-\Delta p$ characteristic of the light beam 18 projected to these regions is satisfactorily corrected by the second lens 44.

FIG. 22A shows an X-Y cross section of the first and second lenses, and FIG. 22B shows an X-D cross section of these lenses. In FIG. 22, the D-axis is inclined at an angle (e.g. 45°) with respect to the Y-axis or Z-axis. In this lens system 43, as shown in FIG. 22A, the first lens 45 has such an aspherical surface as to correct, almost completely, the $\gamma-\Delta p$ characteristic of the light beam 18 projected to the horizontal axis and the vertical axis of the panel and the vicinity thereof, whereas the second lens 44 has an almost flat surface that does not have the correction function. On the other hand, as shown in FIG. 22B, the second lens 44 has such an aspherical surface as to mainly correct the $\gamma-\Delta p$ characteristic of the light beam 18 projected to the regions, excluding the horizontal axis, the vertical axis and the vicinity thereof, and also the first lens 45 has an aspherical surface for carrying out the secondary correction.

As has been stated above, the correction lens system 43 comprising the first and second lenses 45 and 44 can prevent the landing errors from occurring. Such errors occur when the surface height at a given point of the correction lens, that is determined by moving a point on the Y-axis along the Z-axis, differs from the surface height at said given point, that is determined by moving a point on the Z-axis along the Y-axis. Thus, excellent landing characteristics can be obtained over the entire phosphor screen. Furthermore, the design of the lenses is very easy.

Figure 23:
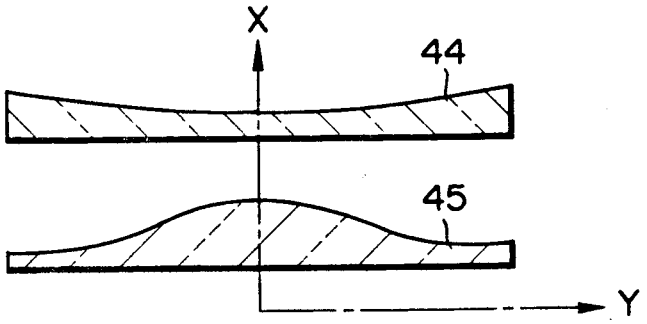
FIG. 23 and FIG. 24 show lens systems different from the lens system shown in FIG. 21.
Figure 24:
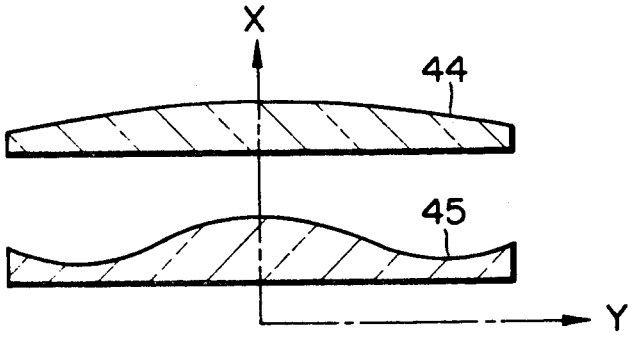

In the above embodiment, the first lens 45 has such an aspherical surface as to correct, almost completely, the $\gamma-\Delta p$ characteristic of the light beam 18 projected to the horizontal axis and the vertical axis of the panel and the vicinity thereof, whereas the second lens 44 has an almost flat surface that does not have the correction function. As shown in FIGS. 23 and 24, however, both first lens 45 and second lens 44 may have positive or negative inclinations along the horizontal axis and the vertical axis, so that the $\gamma-\Delta p$ characteristic of the light beam projected to the horizontal axis and the vertical axis of the panel and the vicinity thereof can be corrected by both lenses 45 and 44. The degree of freedom of lens design is increased by combining the shapes of the surfaces (along the horizontal axis, vertical axis, and the vicinity thereof) of the first and second lenses 45 and 44. Consequently, the second lens 44 can correct, with less errors, the $\gamma-\Delta p$ characteristic of the light beam projected to the regions, other than the horizontal axis, the vertical axis and the vicinity thereof, because the shape of the second lens along the horizontal axis, vertical axis, and the vicinity thereof have been determined.

In the above embodiment, the first lens 45 is designed to correct the $\gamma-\Delta p$ characteristic of the light beam projected to the horizontal axis and the vertical axis of the panel and the vicinity thereof, whereas the second lens 44 is designed to correct the $\gamma-\Delta p$ characteristic of the light beam projected to the regions, excluding the horizontal axis, the vertical axis and the vicinity thereof. Inversely, it is possible to design the second lens 44 to correct the $\gamma-\Delta p$ characteristic of the light beam projected to the horizontal axis and the vertical axis of the panel and the vicinity thereof, and to design the first lens 45 to correct the $\gamma-\Delta p$ characteristic of the light beam projected to the regions, excluding the horizontal axis, the vertical axis and the vicinity thereof. Furthermore, the first and second lenses 45 and 44 may share these functions.

As has been described above, the shutter is employed to limit those regions of the coating film (made of photosensitive resin or phosphor slurry) formed on the inner surface of the panel, which are to be exposed by light beams. In synchronism with the motion of the shutter, the exposure light source is moved to carry out the exposure. The light source is arranged so as to make the horizontal deflection center and the vertical deflection center, both based on the $\gamma-\Delta p$ characteristic, coincide substantially with each other. Thus, there is obtained a color cathode ray tube having excellent landing characteristics all over the entire phosphor screen.

Further, the shutter is employed to limit those regions of the coating film (made of photosensitive resin or phosphor slurry) formed on the inner surface of the panel, which are to be exposed by light beams. In synchronism with the motion of the shutter, the exposure light source is moved, for carrying out the exposure, in a plane including a center axis of the panel and one of a horizontal axis and a vertical axis both intersecting at right angles with the center axis. The light source is arranged so as to make the horizontal deflection center and the vertical deflection center, both based on the $\gamma-\Delta p$ characteristic, coincide substantially with each other. Thus, there is obtained a color cathode ray tube having excellent landing characteristics all over the entire phosphor screen.

Further, the shutter is employed to limit those regions of the coating film (made of photosensitive resin or phosphor slurry) formed on the inner surface of the panel, which are to be exposed by light beams. In synchronism with the motion of the shutter, the optical system is moved by the driving device to change the orbit of the light beam emitted from the exposure light source for exposing the coating film, so as to apparently move the exposure light source. Thus, the shift of the light source, which is necessary for forming a phosphor screen having good landing characteristics, can be carried out, with high precision, equivalently by the optical system that changes the light beam orbit.

Further, the correction lens system is employed to approximate the orbit of the light beam emitted from the light source. The light beam is projected onto a phosphor screen formation layer formed on the inner surface of the panel, to the orbit of the electron beam which is emitted from the electron gun of the color cathode ray tube. The correction lens comprises a first lens for correcting mainly the light beam orbit projected to the phosphor screen formation layer on the horizontal axis and the vertical axis of the panel and the vicinity thereof (the horizontal axis and vertical axis intersecting at right angles with the tube axis), and a second lens for correcting mainly the light beam orbit projected to the phosphor screen formation layer on the regions, other than the horizontal axis, the vertical axis and the vicinity thereof. Though it is difficult to make consistent the inclination and thickness of a single lens at every point thereof, this drawback is overcome by the use of this composite lens system. With use of this lens, there is obtained a color cathode ray tube having excellent landing characteristics all over the phosphor screen. In particular, this lens is effective in manufacturing a wide deflection angle color cathode ray tube or a large-sized color cathode ray tube wherein three color phosphor layers of the phosphor screen are of the dot-type or the electron beam apertures in the shadow mask are circular.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of manufacturing a color cathode ray tube, comprising the steps of:

forming a coating film of a photosensitive resin or phosphor slurry on the inner surface of a panel;

mounting a shadow mask having apertures on the panel;

exposing the coating film with a light beam from a light source through a lens system and the shadow mask, thereby forming a pattern corresponding to the apertures of the shadow mask; and developing the coating film, thereby forming a non-light-emitting layer or a phosphor layer, wherein the exposing step includes the steps of limiting exposure by the light beam, by means of a shutter, of various regions of the coating film, moving the light source relative to, and in synchronism with, the operation of the shutter, so as to cause the horizontal deflection center and the vertical deflection center to coincide substantially with each other on the basis of the $\gamma-\Delta p$ characteristic of the cathode ray tube, which reflects the angle of deflection $\gamma$ of the electron beam and the corresponding displacement of the center (F) of the deflection $\Delta p$ from where the center of deflection would be when the angle of deflection is zero, 2. The method according to claim 1, wherein said exposure step includes:

a step of moving the light source while controlling the amount of motion of the light source in the direction of the light axis of the light source and the amount of motion of the light source in the direction of the horizontal axis or the vertical axis, wherein both of said horizontal axis and said vertical axis intersect the light source at right angles, wherein the light source is moved in a first plane which includes said light axis and said horizontal axis, forming the pattern corresponding to the apertures in the shadow mask on the coating film on the inner surface of the panel, and wherein said pattern does not substantially move in the direction of the horizontal axis, in relation to a reference position on a phosphor screen at which a reference pattern corresponding to the apertures in the shadow mask is supposed to be formed when the light source is fixed, and also, when the light source is moved in a second plane including said light axis and said vertical axis, said pattern corresponding to the apertures in the shadow mask does not substantially move in the direction of the vertical axis, in relation to said reference position.

* * * * *